US012196533B2

(12) United States Patent
Stark

(10) Patent No.: US 12,196,533 B2
(45) Date of Patent: Jan. 14, 2025

(54) FAST-TWIST SUBSONIC BULLET

(71) Applicant: Apex Munitions, LLC, Sundance, WY (US)

(72) Inventor: David B. Stark, Sundance, WY (US)

(73) Assignee: Apex Munitions, LLC, Sundance, WY (US)

( * ) Notice: Subject to any disclaimer, the term of this patent is extended or adjusted under 35 U.S.C. 154(b) by 0 days.

(21) Appl. No.: 18/327,437

(22) Filed: Jun. 1, 2023

(65) Prior Publication Data

US 2023/0392910 A1 Dec. 7, 2023

Related U.S. Application Data

(60) Provisional application No. 63/349,932, filed on Jun. 7, 2022.

(51) Int. Cl.
*F42B 12/34* (2006.01)

(52) U.S. Cl.
CPC ..... *F42B 12/34* (2013.01)

(58) Field of Classification Search
CPC ..... F42B 12/34
USPC ..... 102/507–510
See application file for complete search history.

(56) References Cited

U.S. PATENT DOCUMENTS

| | | | | |
|---|---|---|---|---|
| 1,767,308 | A | 6/1930 | Phillips | |
| 4,655,140 | A | 4/1987 | Schirneker | |
| 6,776,101 | B1 | 8/2004 | Pickard | |
| 6,845,717 | B1 | 1/2005 | Sauvestre | |
| 7,681,504 | B2 | 3/2010 | Machina et al. | |
| 7,814,837 | B2 | 10/2010 | Sauvestre | |
| 8,171,852 | B1 | 5/2012 | Rebar | |
| 8,307,768 | B2 | 11/2012 | Czigienyi | |
| D734,419 | S | 7/2015 | Burczynski et al. | |
| 9,316,468 | B2 | 4/2016 | Rall et al. | |
| 9,354,027 | B2 * | 5/2016 | Flint | F42B 12/74 |
| 9,631,910 | B2 | 4/2017 | Fricke | |
| 9,677,862 | B2 * | 6/2017 | Hendrixson | F42B 12/34 |
| 10,072,914 | B2 | 9/2018 | Flint et al. | |
| 10,082,377 | B1 * | 9/2018 | Imhoff | F42B 12/34 |
| 10,823,539 | B1 | 11/2020 | Oberholster et al. | |
| 10,969,208 | B2 * | 4/2021 | Evans | F42B 12/34 |
| 11,428,517 | B2 * | 8/2022 | Agazim | F42B 12/06 |
| 2005/0241523 | A1 | 11/2005 | Schikora et al. | |
| 2007/0193468 | A1 | 8/2007 | Sauvestre | |

FOREIGN PATENT DOCUMENTS

| | | | | |
|---|---|---|---|---|
| DE | 102015110097 | A1 * | 12/2016 | F42B 12/34 |

* cited by examiner

*Primary Examiner* — Reginald S Tillman, Jr.

(74) *Attorney, Agent, or Firm* — Semprebon Patent Services; Jeffrey E. Semprebon

(57) ABSTRACT

A bullet designed to expand reliably at subsonic velocities has a front end region divided by notches into petals and a groove on its exterior surface. Each notch may be separated into a notch forward segment and a notch rear segment by a discontinuity. Each notch may be cut with a depth such as to provide a web of material extending along a portion of the length of a central cavity.

19 Claims, 7 Drawing Sheets

FAST-TWIST SUBSONIC BULLET

FIELD OF THE INVENTION

The present invention relates to a bullet designed to expand reliably when it impacts a target at subsonic or transonic velocities.

BACKGROUND

Expanding bullets which deform to an increased cross-section upon impact with a target are preferred in many situations, as the increased cross-section enhances the effectiveness of the bullet by increasing its ability to transfer kinetic energy to the target. However, reliable expansion has been found problematic for bullets fired at relatively low velocities, as the dynamic forces that may be employed to cause expansion are correspondingly lower. This is a particular concern for bullets designed for suppressed firearms, as the velocity of such bullets is frequently limited by the desire to avoid velocities which are sufficient to break the sound barrier, which would greatly reduce the effectiveness of suppressing the sound of the gunshot.

One attempt to provide reliable expansion of a bullet at subsonic velocities employs a bullet with slots that separate a front region of the bullet into an array of "petals", in combination with a ram element in a cavity in the front end of the bullet, as taught in U.S. Pat. No. 9,631,910 of Lehigh Defense, LLC. In this design, the ram element is forced rearward when the bullet impacts the target, and this rearward motion acts to spread the petals apart to increase the cross-section of the bullet.

For many applications, the deficiencies of earlier bullet designs have been overcome by the bullets disclosed in U.S. Pat. No. 10,823,539, incorporated herein by reference.

SUMMARY

While bullets such as disclosed in U.S. Pat. No. 10,823,539 have been found to provide reliable expansion, even when fired at subsonic velocities, they may lack sufficient structural integrity to withstand the rotational forces when fired from a barrel having an extremely high rifling twist rate. For example, in 0.300 Blackout, such bullets as made by Applicant have been found effective in barrels having a relatively fast 1-in-5" twist rate, but may not have sufficient integrity when fired through a barrel having an extremely fast twist rate such as 1-in-3" which imparts ⅔ greater rotational velocity for the same linear velocity (linear velocity typically being capped at about 1,000 ft/s to maintain the bullet subsonic for use with a sound suppressor). This is a greater concern for larger diameter rounds, as the tangential speed at the circumference of the bullet increases as its diameter increases, for the same angular velocity.

To provide reliable expansion at subsonic velocities, similar to that of the bullets disclosed in U.S. Pat. No. 10,823,539, but with greater structural integrity so as to better withstand forces imparted by high rotational speeds, bullets can be designed with notches that are configured to provide greater structural integrity in areas of the bullet where increased resistance to rotational forces is needed. Such bullets may have exterior profiles similar to those disclosed in U.S. Pat. No. 10,823,539.

A bullet can have an elongated body terminating at a front end and a rear end, and symmetrically disposed about a longitudinal central axis; the length between the front end and rear end measured along the central axis defines a bullet length $L_B$. The bullet has an exterior maximum bullet diameter $D_B$. A cavity terminates at the front end and extends rearward there from along the central axis, defining a cavity length $L_C$. A groove circumscribes the body at a location spaced apart from the front end. Longitudinal notches are provided to divide a forward portion of the bullet into petals, the notches extending generally parallel to the central axis and extending inwards from the exterior surface towards the cavity, in some case, portions of the notch intersect the cavity. The groove may be configured to allow a forward portion of the petals to bend to a limited degree, facilitating expansion in a manner similar to that of the bullets disclosed in the '539 patent.

The notches may each be formed with a notch forward segment, which extends rearward from the front end to a discontinuity, and a notch rear segment, which extends rearward from the discontinuity and is aligned with the notch forward segment. The discontinuity may be located so as to extend entirely or partially through the groove, or may be forward of or rearward of the groove. The discontinuity may entirely interrupt the notch, extending to an exterior surface of the bullet (including the groove as the exterior surface), or may be formed by a region of the notch having a significantly shallower depth than that of the notch segments. The notch segments may be formed by a varying depth of cut, and in some cases a change in depth of cut may create the discontinuity. In some case, one or both of the notch segments intersects the cavity. The notch rear segment may have an average rear segment length $L_{RS}$, which may be proportioned relative to other dimensions, such as bullet diameter $D_B$, bullet length $L_B$, cavity length $L_C$, maximum petal thickness $T_P$. Where the notch is formed by a circular cutting tool, the rear segment length $L_{RS}$ may be defined by the length along the central axis where the arc of the tool intersects a line parallel to the central axis and positioned at one half the notch depth $Z_N$. In other cases, the rear segment length $L_{RS}$ could be determined by an actual average of the length of the notch rear segment extending forwards that would result (if the exterior contour of the bullet were cylindrical).

Since the exterior of the bullet typically follows a curved or curvilinear profile, the actual depth of the notches changes as the exterior contour changes, and thus "depth" of the notches or notch segments can be defined by the depth of cut required to form the notch/segment (i.e., the separation of the cutting tool from the central axis), rather than the actual depth at any particular point relative to the exterior surface of the bullet. In some cases, the cavity is segmented with a cavity front segment terminating at the front end having a greater diameter than a cavity rear segment; in such cases, the notch forward segment may intersect the cavity while the notch rear segment does not, despite having a shallower or equal depth of cut.

The notches may be formed with a depth selected to form a web of material between the notch and the cavity, extending along a portion of the cavity length $L_C$. Where such notches are formed with a discontinuity, the depth of cut of the notch segments can be selected so as to provide a similar web thickness $T_W$ of the web of material between each notch segment and the corresponding cavity segment. The web thickness $T_W$ may be defined as a proportion of the bullet diameter $D_B$ or the maximum petal thickness $T_P$.

BRIEF DESCRIPTION OF THE FIGURES

FIGS. 10 & 11 show examples where the notch segments are formed by a circular cutting tool and thus are defined by arcuate ends. FIG. 11 shows some dimensions, including the average notch length $L_N$, the average discontinuity length $L_D$, the average notch forward segment length $L_{FS}$, the average notch rear segment length $L_{RS}$, and the length $L_B$ and diameter $D_B$ of the bullet.

FIGS. 12-14 show examples where neither notch segment intersects the cavity, while FIG. 15 shows an example where the notch forward segment intersects the cavity. FIG. 16 shows an example where a change in notch depth forms the discontinuity.

DETAILED DESCRIPTION

Figure 1:
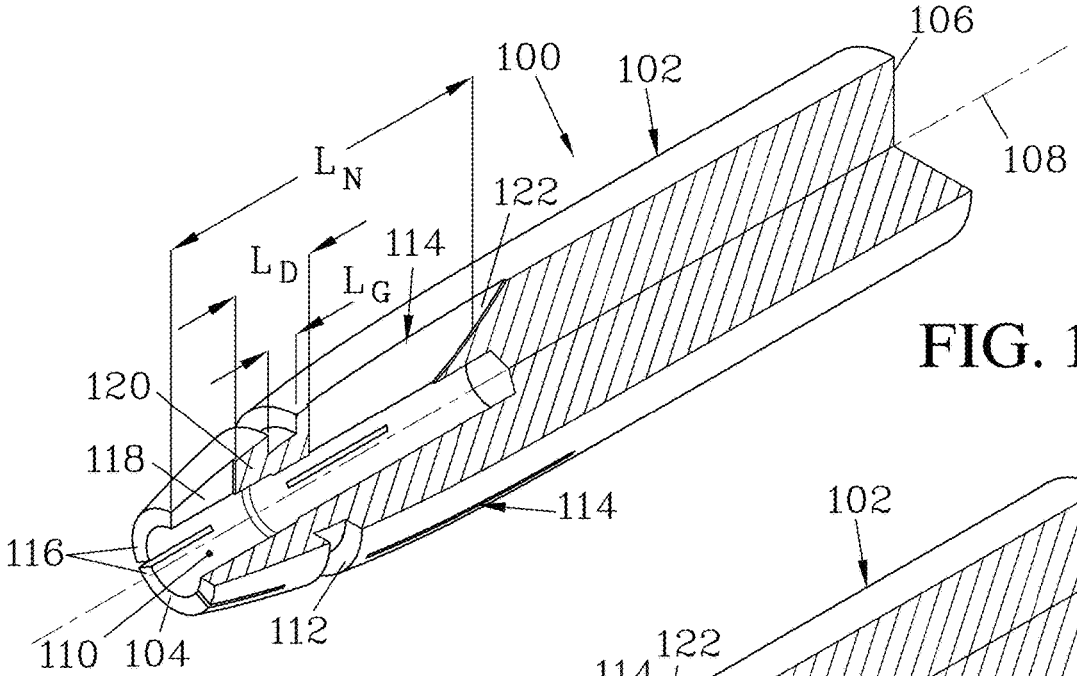
FIGS. 1-3 show bullets having a continuous ogive exterior profile and various configurations of notches that are each formed with a discontinuity between a notch forward segment and a notch rear segment.

Common elements appearing in the various bullet configurations illustrated in the partially-sectioned isometric views are as follows:

bullet 100;
elongated body 102;
front end 104;
rear end 106;
central axis 108;
cavity 110;
groove 112;
notches 114;
petals 116;
notch forward segment 118;
discontinuity 120; and
notch rear segment 122.

Figure 2:
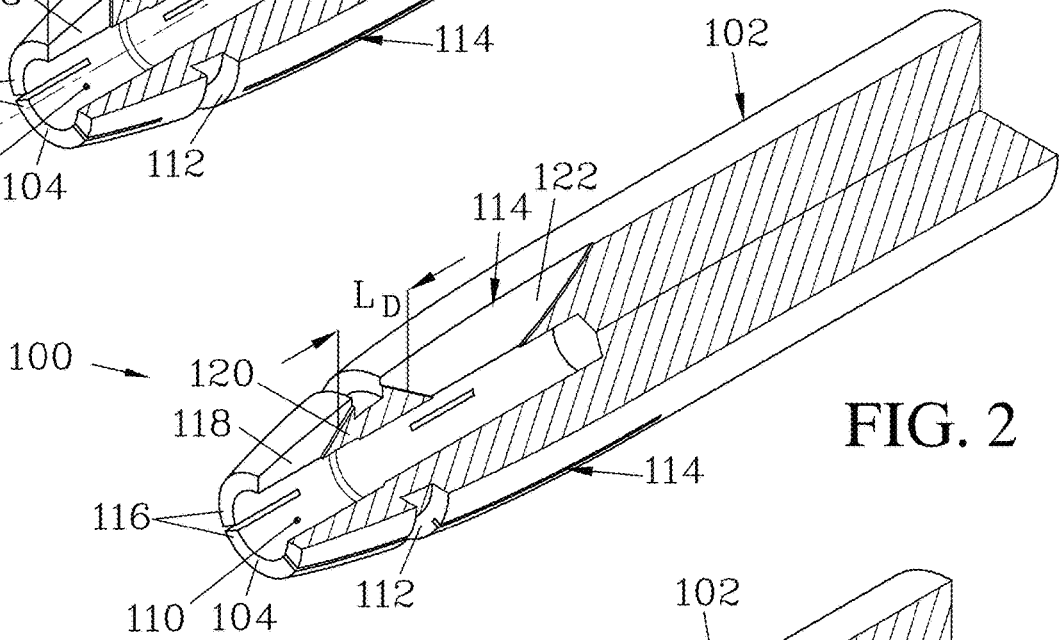
Figure 3:
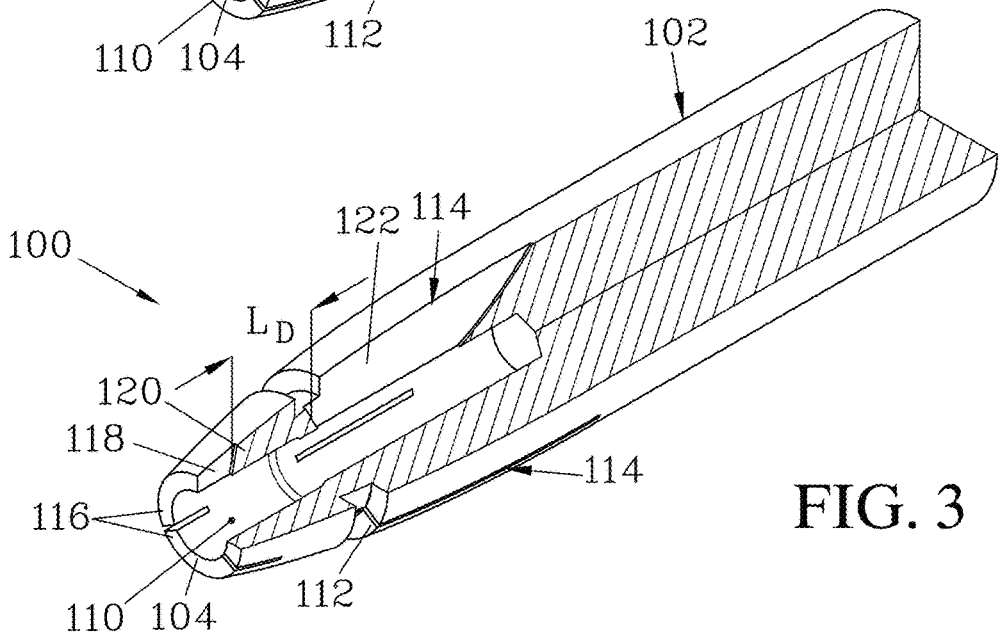

FIGS. 1-3 show bullets 100 having a continuous ogive exterior profile. In FIG. 1, the bullet 100 has three notches 114, each having a notch forward segment 118 and a notch rear segment 122 that are separated by a discontinuity 120. The notch 114 has an average length $L_N$ extending the length of both segments (118, 122), and divides a forward portion of the bullet 100 into three petals 116. The discontinuity 120 has a length $L_D$ (the discontinuity 118 in FIG. 1 is defined by cuts that extend perpendicular to a central axis 108). In the FIG. 1 bullet, the discontinuity 120 extends through the region of the bullet 100 having a groove 112, such that neither notch segment (118, 122) extends into the groove 112. The groove 112 has a length $L_G$.

FIG. 2 shows a bullet 100 where each of the notch segments (118, 122) extends partway into the groove 112. The discontinuity 120 in FIG. 2 is defined by angled cuts, and has an average length $L_D$.

FIG. 3 shows a bullet 100 where the notch rear segment 122 extends into the groove 112, but where the notch forward segment 118 does not. The discontinuity 120 extends through a portion of the groove 112.

Figure 4:
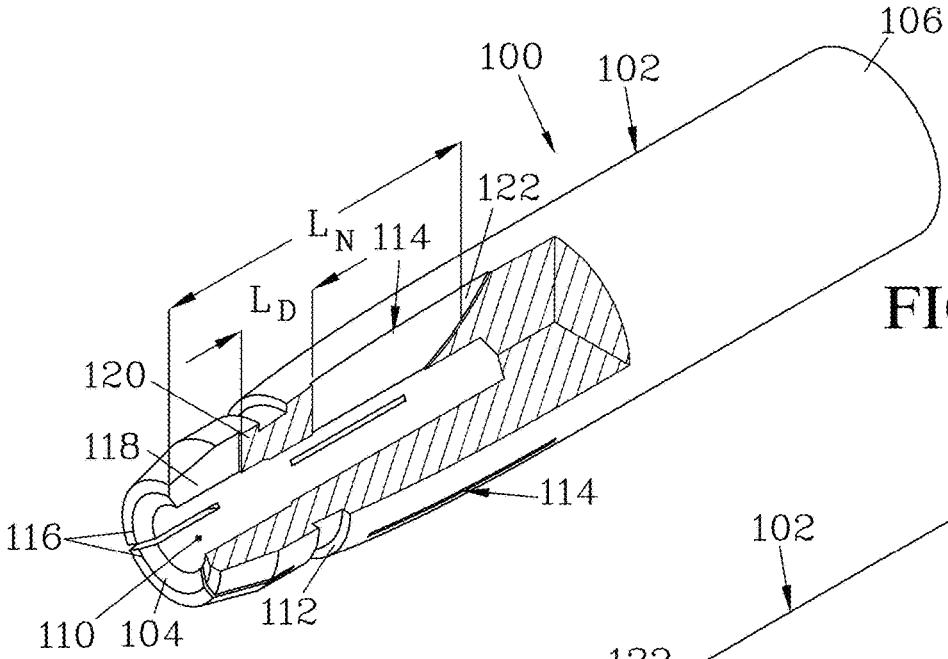
FIGS. 4-6 show bullets having a pressure-reducing profile forward of the groove, and notch configurations respectively similar to those shown in FIGS. 1-3.

FIGS. 4-11 show bullets 100 having a pressure-reducing profile forward of the groove. FIG. 4 shows a bullet 100 where neither notch segment (118, 122) extends into the groove 112, and the discontinuity 120 extends across the groove 112. Other than where the notch intersects the exterior surface, the notch profile is the same as that of the bullet shown in FIG. 1.

Figure 5:
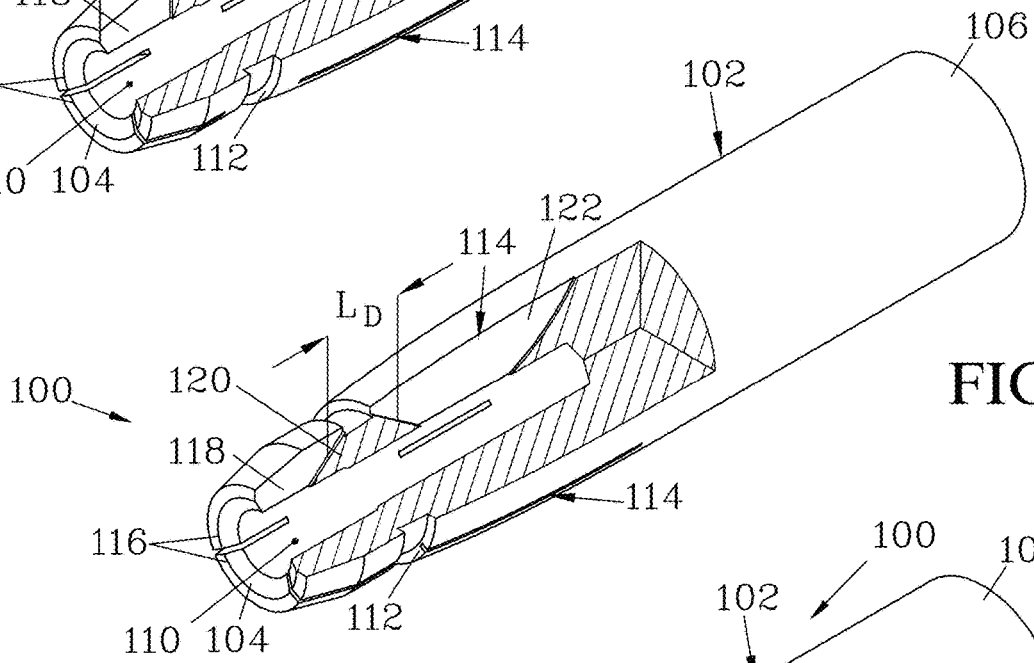

FIG. 5 shows a bullet 100 where each of the notch segments (118, 122) extends partway into the groove 112. Other than where the notch intersects the exterior surface, the notch profile is the same as that of the bullet shown in FIG. 2.

Figure 6:
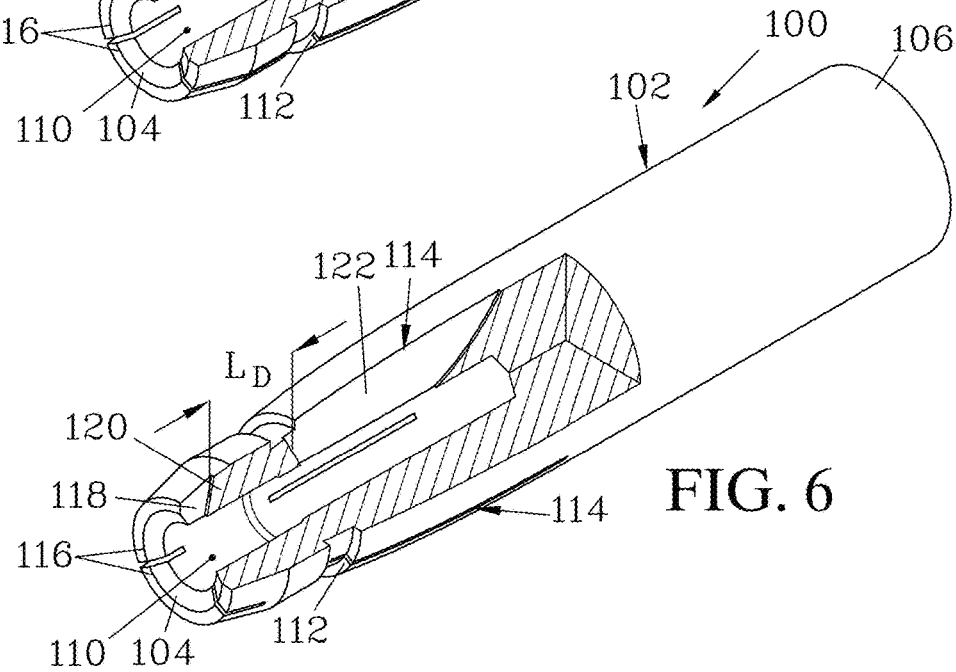

FIG. 6 shows a bullet 100 where the notch rear segment 122 extends into the groove 112, but where the notch forward segment 118 does not. The discontinuity 120 extends through a portion of the groove 112. Other than where the notch intersects the exterior surface, the notch profile is the same as that of the bullet shown in FIG. 3.

Figure 7:
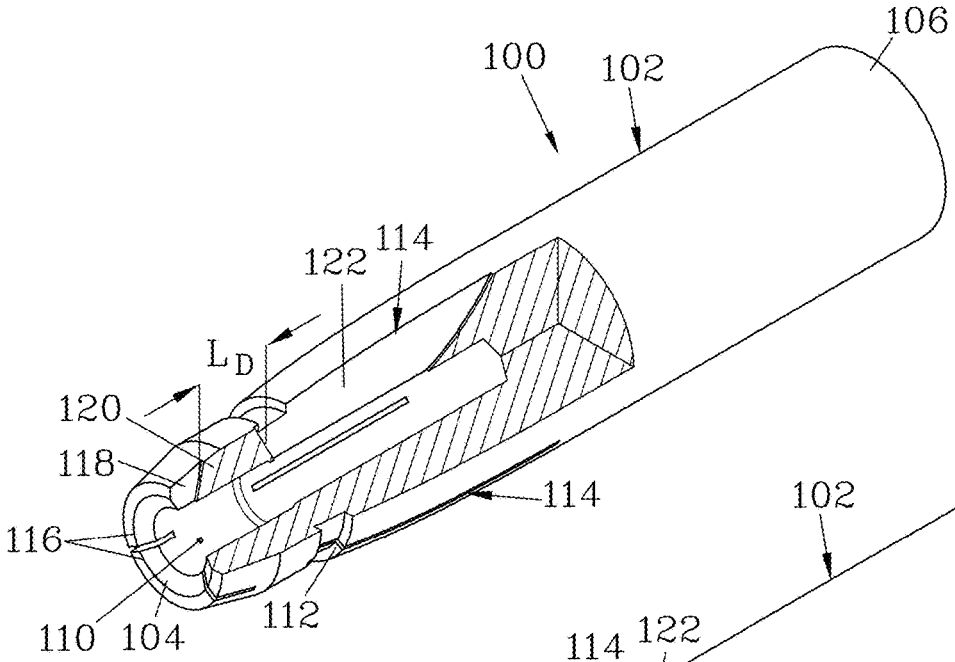
FIGS. 7-11 show further notch configurations for bullets having a pressure-reducing profile forward of the groove.

FIG. 7 shows a bullet 100 where the notch rear segment 122 extends entirely through the groove 112, and thus the discontinuity 120 is positioned forward of the groove 112.

Figure 8:
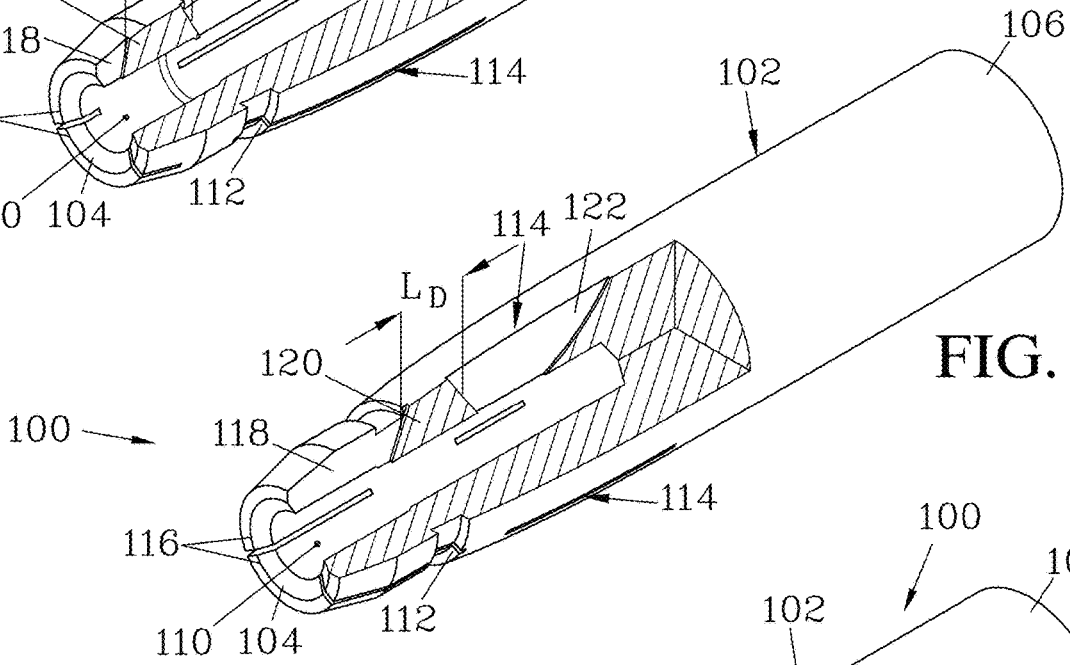

FIG. 8 shows a bullet 100 where the notch front segment 122 extends through the groove 112, and thus the discontinuity 120 is positioned rearward of the groove 112.

Figure 9:
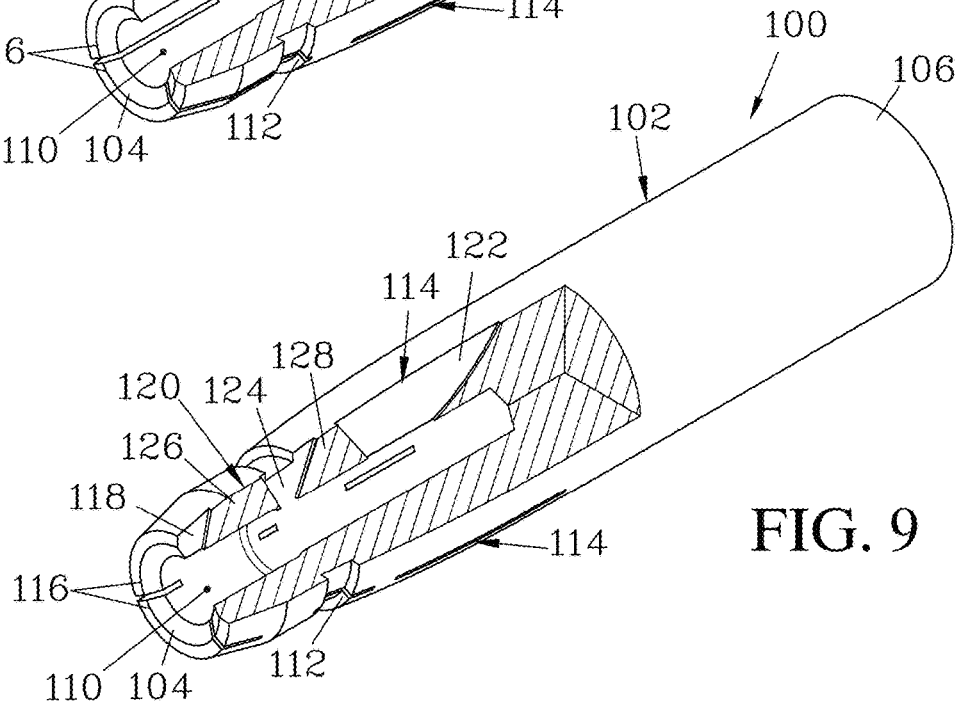

FIG. 9 shows a bullet 100 where the notch has an additional notch segment 124, which divides the discontinuity 120 into a discontinuity forward segment 126 and a discontinuity rear segment 128. Alternatively, the notch could be considered as having two discontinuities and three notch segments.

Figure 10:
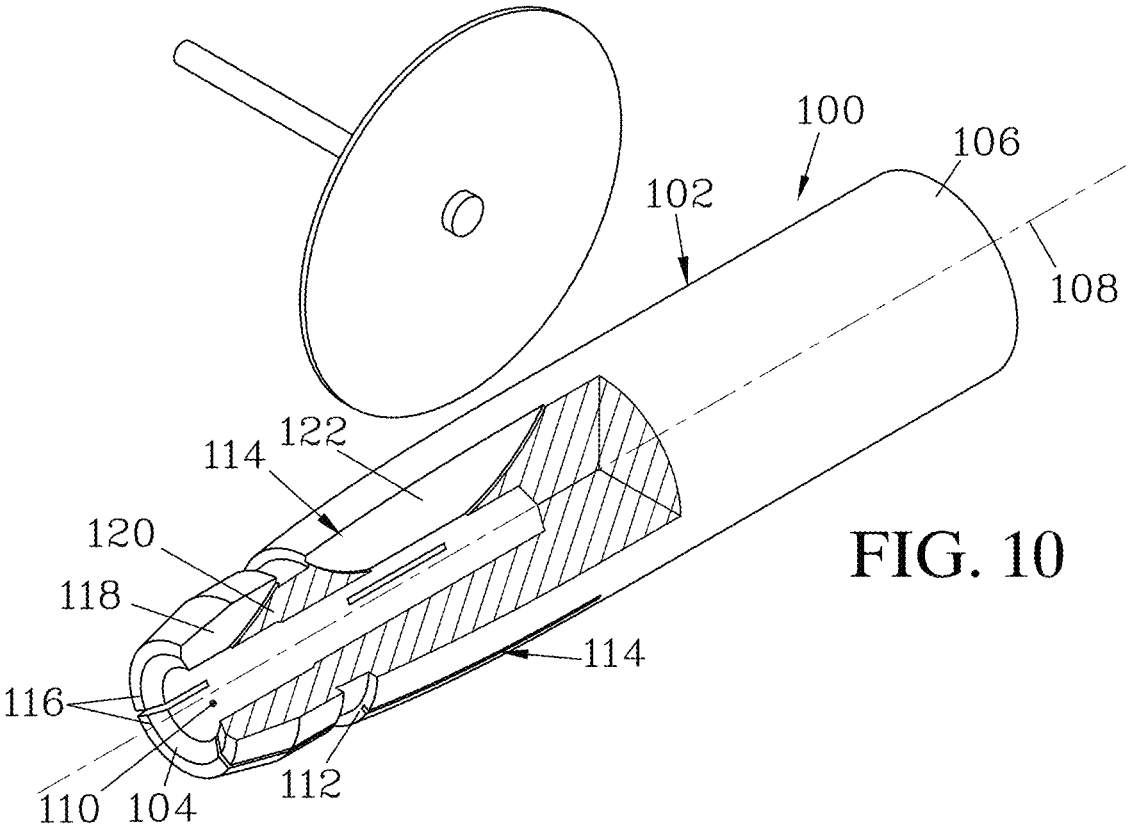
Figure 11:
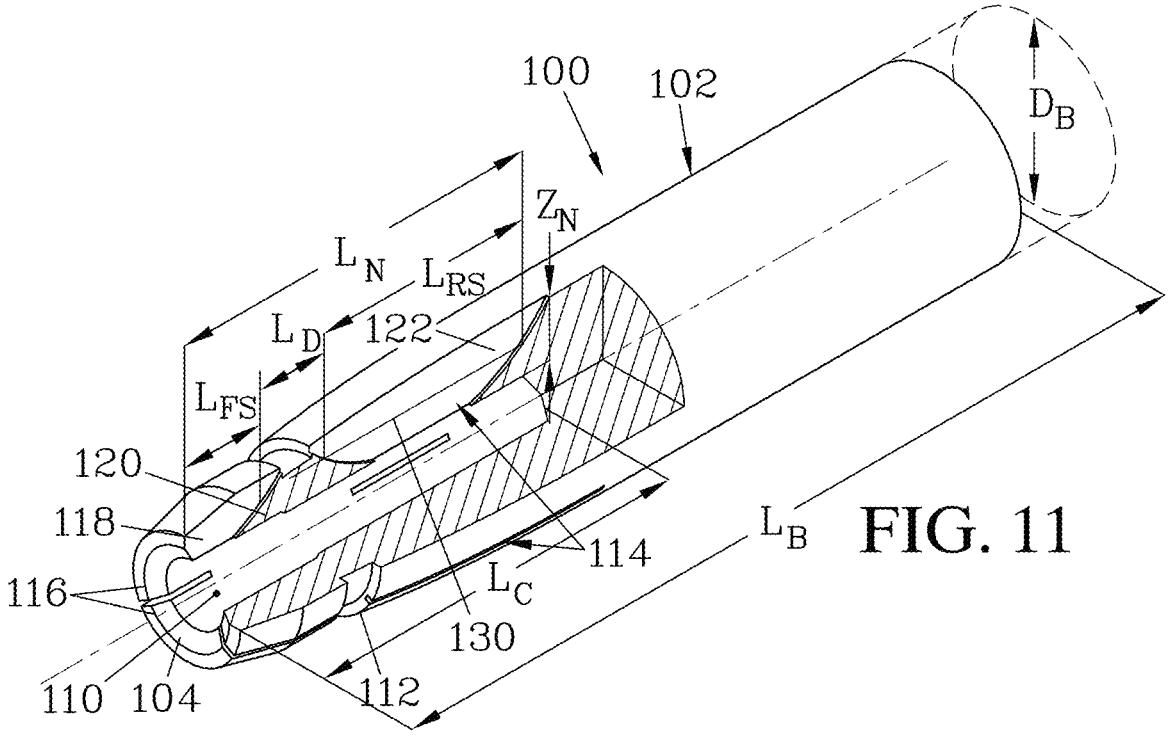

FIGS. 10 & 11 show a bullet 100 where the notch segments (118, 122) are formed by a circular cutting tool (shown in FIG. 10), and thus are defined by arcuate ends. FIG. 11 shows some dimensions, including the average length $L_N$ of the notch 114, the average length $L_D$ of the discontinuity 120, the average length $L_{FS}$ of the notch forward segment 118, the average length $L_{RS}$ of the notch rear segment 122, the bullet length $L_B$ and bullet diameter $D_B$ of the bullet 100, and the cavity length $L_C$ of the cavity 110. For ease of measurement, the "average" lengths of the notch segments ($L_{FS}$, $L_{RS}$) may be defined by the length (measured parallel to the central axis 108) where the arc of the tool intersects a half-depth reference line 130 that is parallel to the central axis 108 and is positioned at one half the notch depth $Z_N$.

The dimensions of the notch segments and discontinuity depend on a number of factors, which may include the particular bullet design and composition, the intended velocity and barrel twist rate, and the expected composition of the target, as well as the bullet diameter. While average lengths are illustrated, the lengths could be defined based on their interior length along the surface of the cavity 110, or externally along the exterior of the bullet 100. While three notches are illustrated, two or four notches could be employed, and could offer greater flexibility in profiles when cutting the notch segments (118, 122), as the cutting tool could pass completely through the cavity 110.

FIGS. 12-16 show some examples of bullets having notch segments which do not extend through to the cavity, and where the discontinuity may not extend to the exterior surface. The notches as illustrated are formed by a rotary cutting tool, but other tools for forming cuts or perforations could be employed. For a particular bullet design and intended twist rate, cutting to form notches having a variable profile can be used to adjust the structural integrity of the bullet along the length of the notch to obtain a desired profile of bullet strength to provide both sufficient structural integrity to resist rotational forces as well as sufficient weakness to allow reliable expansion of the petals when the bullet impacts a target. While five examples are shown, other variations could be employed. While distinct transitions between the notch segments and the discontinuity are shown, a more gradual transition could be employed, such that there is no clear demarcation of where a notch segment ends and the discontinuity begins, so long as there is an overall region of decreased notch depth that serves to provide a discontinuity that provides increased structural integrity at its location.

Figure 12:
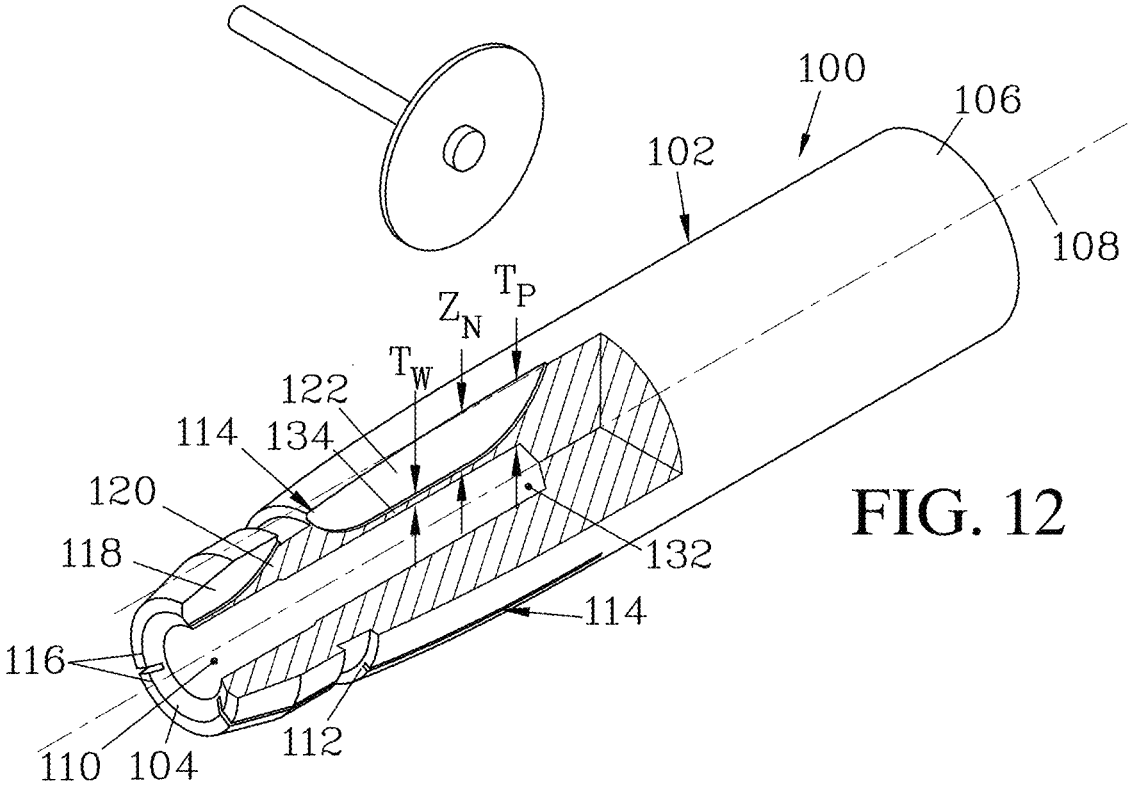
FIGS. 12-16 show some examples of bullets having notch segments which do not extend through to the cavity, leaving a web of material between the notch and the cavity.

FIG. 12 shows a bullet 100 where a small-diameter cutting tool has been employed to form notches 114 that each have a notch forward segment 118 and a notch rear segment 122, separated by a discontinuity 120, where the cutting tool depth of cut has been limited such that the notch segments (118, 122) do not extend through to the cavity 110. The notch segments (118, 122) in FIG. 12 are formed by inserting the cutting tool to a set depth (i.e., a specified distance from the central axis 108) and moving it axially along the bullet 100 for a short distance to cut the desired segment length. Thus, except for the curved ends, the notch segments have a constant notch depth $Z_N$. In this case, the cavity 110 has a cavity rear segment 132 with a constant diameter, so cutting the notch rear segment 122 results in a web 134 of material separating the notch 114 from the cavity 110 where the web 134 has a constant web thickness $T_W$, extending along a portion of the cavity length $L_C$ (shown in FIG. 11). FIG. 12 also shows a maximum petal thickness $T_P$ separating the cavity rear segment 132 from the exterior surface of the bullet.

Figure 13:
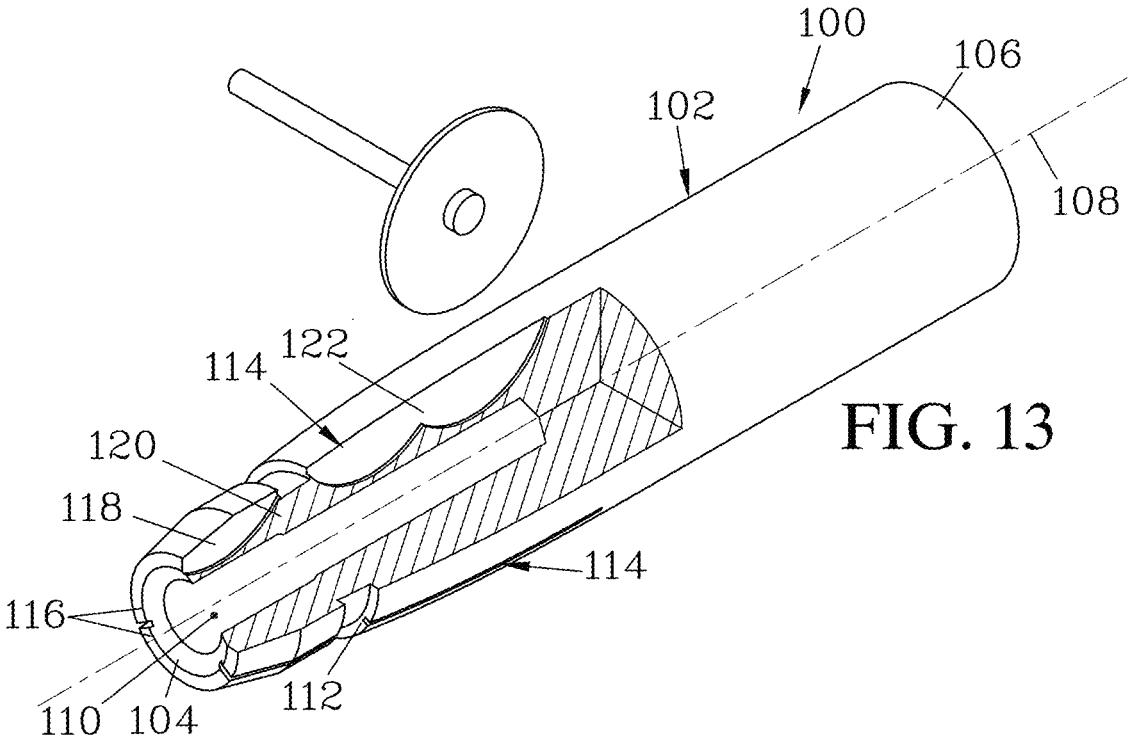

FIG. 13 shows a bullet 100 similar to that shown in FIG. 12, but where the notch segments (118, 122) are formed by inserting and withdrawing the cutting tool at several locations along the length of the bullet 100, such that the segments (118, 122) have a continually varying depth. In such cases, the average depth could be defined as the notch depth for each segment. Again, the depth of the cuts has been selected such that the notch segments (118, 122) do not extend through to the cavity 110.

Figure 14:
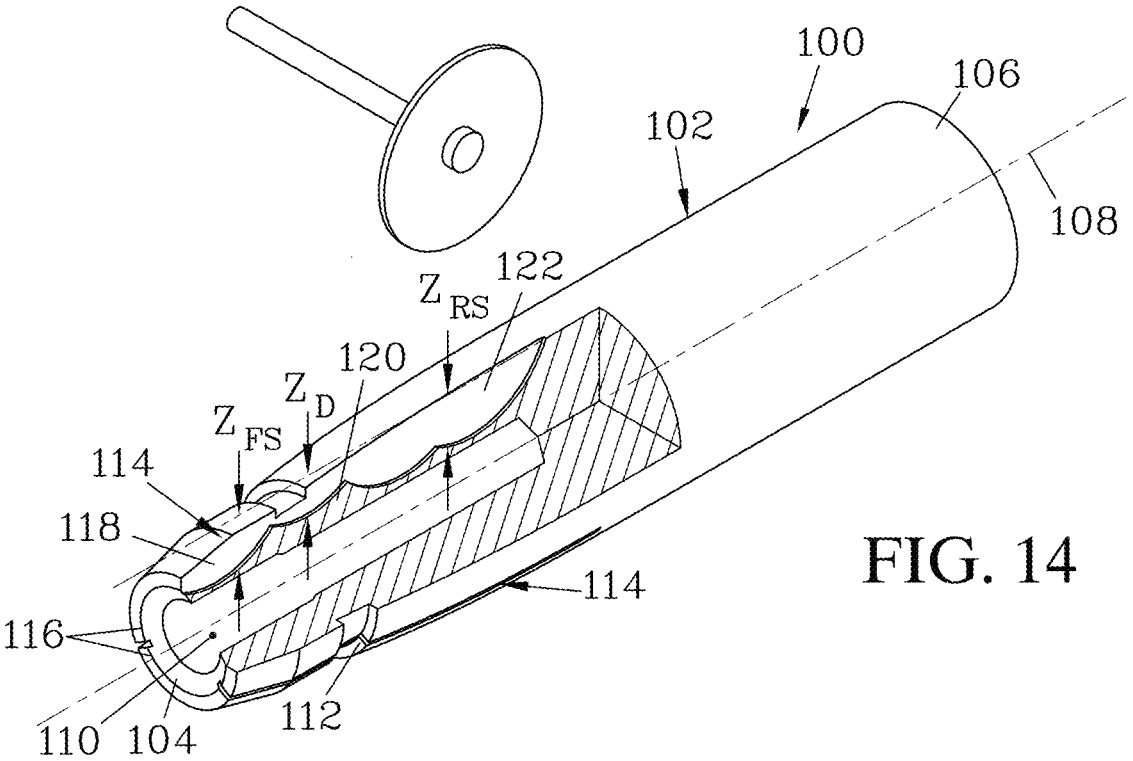

FIG. 14 shows a bullet 100 similar to that shown in FIG. 13, but where the discontinuity is formed by a shallower-depth cut of the cutting tool, and thus does not extend to the exterior surface of the bullet 100. This notch 114 could be considered as quasi-continuous, as the discontinuity 120 is formed by a region of significantly-decreased notch depth rather than a complete interruption of the notch 114. As used here, a change in notch depth is considered significant if the change in depth is sufficiently great as to materially change the structural integrity of the bullet at that location. The discontinuity 120 has an average depth $Z_D$ that is significantly less than the average depth $Z_{FS}$ of the notch forward segment 118 and the average depth $Z_{RS}$ of the notch rear segment 122.

Figure 15:
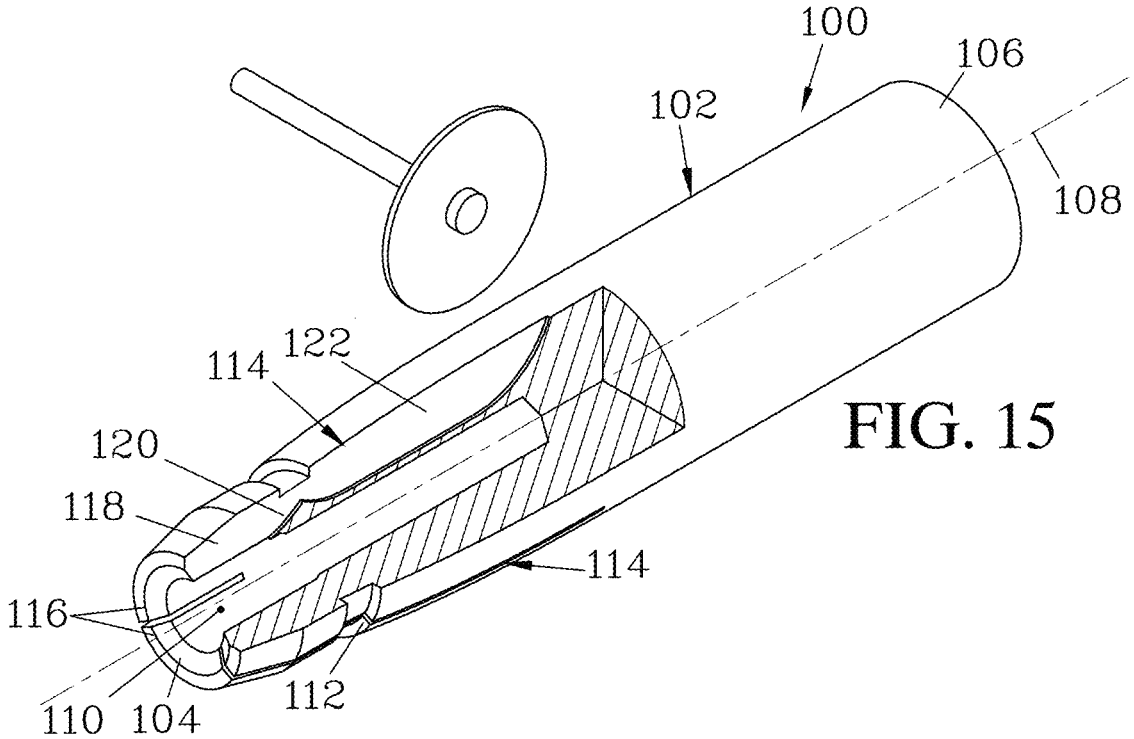

FIG. 15 shows a bullet 100 similar to that shown in FIG. 12, but where the forward notch segment 118 has been cut with sufficient depth to extend through to the cavity 110.

Figure 16:
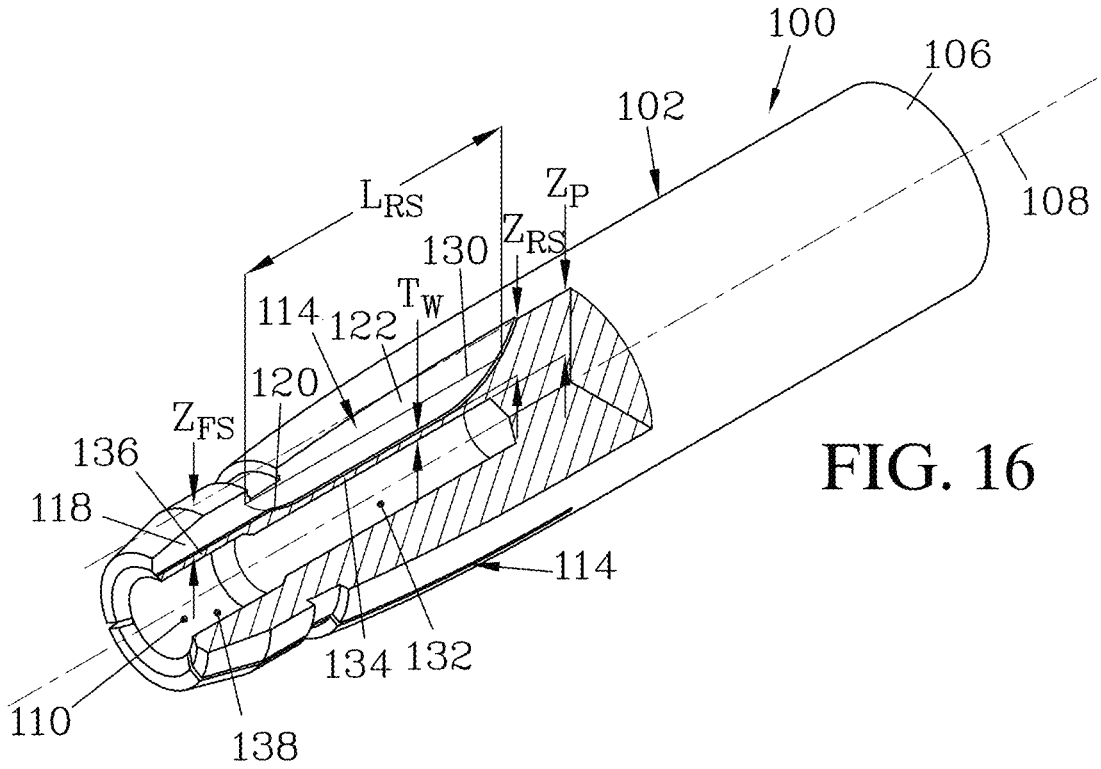

FIG. 16 shows a bullet 100 where a discontinuity 120 is formed by a change in notch depth between a notch rear segment 122 and a notch forward segment 118. The forward segment depth $Z_{FS}$ is formed by the cutting tool placed at a reduced cut depth (i.e., a greater distance from the central axis 108) than the cut depth used to form the rear segment depth $Z_{RS}$. This change in cutting tool depth forms a step-like discontinuity 120 between the notch segments (118, 122). FIG. 16 also shows a rear segment average length $L_{RS}$ that is measured as the length between points where a mid-depth line 130 intersects the arcs of the cutting tool used to form the notch rear segment 122. At the forward end of the notch rear segment 122, the mid-depth line intersects a projection of the arcuate surface of the notch rear segment (corresponding to the position of the circular cutting tool when forming the notch rear segment 122). The cut depth results in a web 134 extending between the notch rear segment 122 and the cavity rear segment 132, as well as a forward web 136 extending between the notch forward segment 118 and a cavity forward segment 138. The segment depths ($Z_{FS}$, $Z_{RS}$) may be selected relative to the cavity segment diameters such that the web 134 and the forward web 136 have equal thickness. FIG. 16 also shows a petal depth $Z_P$ extending between the exterior surface of the bullet and the cavity rear segment 132.

Figure 17:
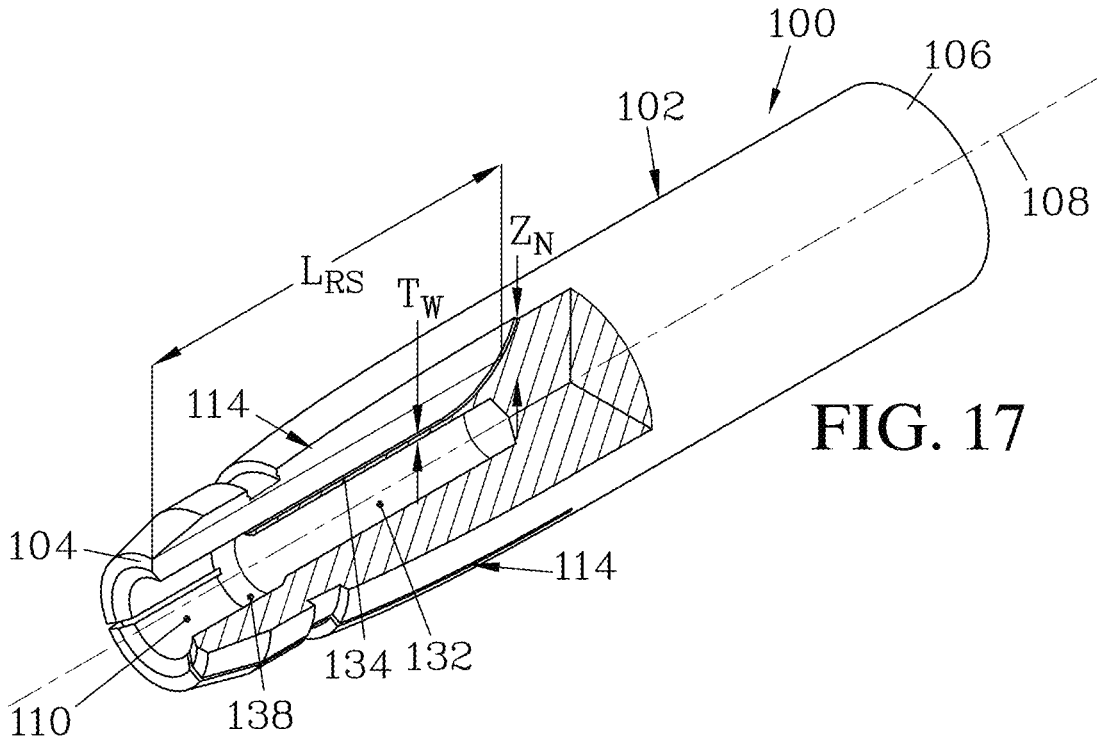
FIG. 17 shows an example where a notch is formed so as to leave a web of material between the notch and the cavity, but where the notch is cut with a continuous depth of cut and thus does not have a discontinuity.

FIG. 17 shows a bullet 100 where a notch 114 is formed by cutting at a constant notch depth $Z_N$, so as to leave a web 134 of material between the notch 114 and the cavity 110. Because the notch is cut with a continuous depth of cut, the notch 114 in this case does not have a discontinuity. The notch rear segment average length $L_{RS}$ could be considered to extend to the front end 104 of the bullet 100. While the depth of cut is constant, a cavity forward segment 138 has a larger diameter than a cavity rear segment 132, and thus the notch 114 may intersect the cavity forward segment 138.

Preliminary testing of monolithic bullets made from copper alloy suggests that the rear segment average length $L_{RS}$ should meet at least one of the following minimum length criteria:

measuring at least 0.350" in length,
measuring at least 80% of the bullet diameter $D_B$,
measuring at least 250% of a maximum petal thickness $T_P$,
measuring at least 15% of a bullet overall length $L_B$, and
measuring at least 40% of the cavity length $L_C$.

The notch may be further configured such that the rear segment average length $L_{RS}$ meets at least one of the following maximum length criteria:

measuring up to 1.500" in length,
measuring up to 200% of the bullet diameter $D_B$,
measuring up to 600% of a maximum petal thickness $T_P$,
measuring up to 50% of a bullet overall length $L_B$, and
measuring up to 100% of the cavity length $L_C$.

It may be preferred for the rear segment average length $L_{RS}$ to meet at least one of the following minimum length criteria:

measuring at least 0.400" in length,
measuring at least 100% of the bullet diameter $D_B$,
measuring at least 300% of a maximum petal thickness $T_P$,
measuring at least 20% of a bullet overall length $L_B$, and
measuring at least 50% of the cavity length $L_C$.

The notch may be further configured such that the rear segment average length $L_{RS}$ meets at least one of the following preferred maximum length criteria:

measuring up to 1.00" in length,
measuring up to 175% of the bullet diameter $D_B$,
measuring up to 500% of a maximum petal thickness $T_P$,
measuring up to 40% of a bullet overall length $L_B$, and
measuring up to 85% of the cavity length $L_C$.

In general, bullets having a greater diameter (and thus exposed to greater tangential velocities for the same angular velocity) should benefit from having a relatively shorter rear segment average length $L_{RS}$, while bullets having a smaller diameter should benefit from having a relatively longer rear segment average length $L_{RS}$. For bullets in the range of 0.338" diameter, it may be preferred for the rear segment average length $L_{RS}$ to meet at least one of the following minimum length criteria:

measuring at least 0.440" in length, measuring at least 130% of the bullet diameter $D_B$, measuring at least 370% of a maximum petal thickness $T_P$, measuring at least 25% of a bullet overall length $L_B$, and measuring at least 65% of the cavity length $L_C$.

For such bullets, it may be preferred for the rear segment average length $L_{RS}$ meets at least one of the following maximum length criteria:

measuring up to 0.500" in length, measuring up to 150% of the bullet diameter $D_B$, measuring up to 400% of a maximum petal thickness $T_P$, measuring up to 30% of a bullet overall length $L_B$, and measuring up to 75% of the cavity length $L_C$.

Where the notch is cut so as to provide a web of material, the web thickness $T_W$ should meet at least one of the criteria of being between about 0.4% and 15% of the bullet diameter $D_B$, between 1% and 25% of the maximum petal thickness $T_P$, or between about 0.001" and 0.100". It may be preferred for the web thickness $T_W$ to meet at least one of the criteria of being between about 0.7% and 10% of the bullet diameter $D_B$, between 2% and 20% of the maximum petal thickness $T_P$, or between about 0.002" and 0.050". In general, bullets having a greater diameter should benefit from having a relatively greater web thickness $T_W$, while bullets having a smaller diameter should benefit from having a relatively thinner web thickness $T_W$. For bullets in the range of 0.338" diameter, it may be preferred for the web thickness $T_W$ to meet at least one of the criteria of being between about 0.9% and 6% of the bullet diameter $D_B$, between 2.5% and 17% of the maximum petal thickness $T_P$, or between about 0.003" and 0.020".

Several examples of 0.338" diameter bullets with varying notch profiles were tested at velocities between about 850 and 1000 ft/s, with notch geometries and results as indicated in Table 1. Bullets employing one of the notch profiles that provided ideal expansion, penetration, and weight retention were tested on feral pigs ranging in weight from 65 to 100 lbs. and were found to be effective in killing them quickly and humanely.

TABLE 1

| Notch profile | Web $T_W$ | $L_{RS}$ | $L_{RS}/D_B$ | $L_{RS}/T_P$ | $L_{RS}/L_B$ | $L_{RS}/L_C$ |
|---|---|---|---|---|---|---|
| Petals only partially expanded: | | | | | | |
| FIG. 12 | 0.010" | 0.423" | 1.25 | 3.52 | 0.244 | 0.638 |
| FIG. 12 | 0.005" | 0.430" | 1.27 | 3.59 | 0.249 | 0.649 |
| Ideal expansion, penetration, and weight retention: | | | | | | |
| FIG. 16 | 0.010" | 0.456" | 1.35 | 3.80 | 0.264 | 0.688 |
| FIG. 16 | 0.005" | 0.458" | 1.36 | 3.82 | 0.265 | 0.691 |
| Tips of petals sheared off: | | | | | | |
| FIG. 15 | 0.010" | 0.484" | 1.43 | 4.03 | 0.272 | 0.730 |
| FIG. 16 | 0.010" | 0.536" | 1.58 | 4.46 | 0.310 | 0.808 |
| FIG. 17 | 0.010" | 0.611" | 1.81 | 5.01 | 0.353 | 0.922 |
| Expanded prematurely before hitting target: | | | | | | |
| FIG. 15 | 0.005" | 0.486" | 1.44 | 4.05 | 0.281 | 0.733 |
| FIG. 16 | 0.005" | 0.538" | 1.59 | 4.48 | 0.311 | 0.811 |
| FIG. 17 | 0.005" | 0.610" | 1.81 | 5.09 | 0.353 | .0921 |

Bullet designs that expand prematurely at typical subsonic velocities (roughly 750-1050 feet/sec.) may have particular utility at lower velocities (such as about 500-700 fps) for situations where especially low sound signature is desired.

While the novel features of the present invention have been described in terms of particular embodiments and preferred applications, it should be appreciated by one skilled in the art that substitution of materials and modification of details can be made without departing from the spirit of the invention.

The invention claimed is:

1. A bullet comprising:

an elongated body terminating at a front end and a rear end, and symmetrically disposed about a longitudinal central axis;

a cavity terminating at said front end and extending rearward therefrom along the central axis;

a groove circumscribing said body at a location spaced apart from said front end; and a plurality of longitudinal notches extending generally parallel to the central axis and partially extending from said groove towards said rear end, and extending radially inwards towards said cavity, said notches each having a rear segment average length $L_{RS}$ and at least one characteristic selected from the group of, having a notch forward segment extending rearward from said front end to a discontinuity, and a notch rear segment defining the rear segment average length $L_{RS}$ and extending rearward from said discontinuity and aligned with said notch forward segment, and said notch being configured such that the rear segment average length $L_{RS}$ meets at least one criterion selected from the group of, measuring at least 370% of a maximum petal thickness $T_P$, measuring at least 65% of the cavity length $L_C$, and said notch extending inwards to a sufficient depth relative to said cavity so as to create a web extending over at least a portion of a cavity length $L_C$ of said cavity, wherein web has a web thickness $T_W$ that meets at least one criterion selected from the group of, measuring between 0.001" and 0.100" in thickness, measuring between 0.4% and 15% of a bullet diameter $D_B$, measuring between 1% and 25% of a maximum petal thickness $T_P$.

2. The bullet of claim 1 wherein said at least one characteristic includes the characteristic that said notches each have a notch forward segment extending rearward from said front end to a discontinuity, and a notch rear segment extending rearward from said discontinuity and aligned with said notch forward segment.

3. The bullet of claim 2 wherein said discontinuities of said notches are positioned such that said groove traverses said discontinuities.

4. The bullet of claim 2 wherein said discontinuity extends to an exterior surface of the bullet and disrupts said notch.

5. The bullet of claim 2 wherein said discontinuity is formed by a region of said notch having a significantly shallower depth than the depths of said notch forward segment and said notch rear segment.

6. The bullet of claim 5 wherein at least one of said notch forward segment and said notch rear segment extends to said cavity.

7. The bullet of claim 2 wherein said discontinuity is formed by a change in depth with said notch forward segment being formed by a shallower depth of cut than said notch rear segment.

8. The bullet of claim 2 wherein the rear segment average length $L_{RS}$ meets at least one criterion selected from the group of, measuring at least 0.440" in length, measuring at least 130% of the bullet diameter $D_B$, measuring at least 370% of a maximum petal thickness $T_P$, measuring at least 25% of a bullet overall length $L_B$, and measuring at least 65% of the cavity length $L_C$.

9. The bullet of claim 8 wherein the rear segment average length $L_{RS}$ meets at least one additional criterion selected from the group of, measuring up to 0.500" in length, measuring up to 150% of the bullet diameter $D_B$, measuring up to 400% of a maximum petal thickness $T_P$, measuring up to 30% of a bullet overall length $L_B$, and measuring up to 75% of the cavity length $L_C$.

10. The bullet of claim 2 wherein the rear segment average length $L_{RS}$ meets at least one criterion selected from the group of, measuring at least 0.350" in length, measuring at least 80% of the bullet diameter $D_B$, measuring at least 250% of a maximum petal thickness $T_P$, measuring at least 15% of a bullet overall length $L_B$, and measuring at least 40% of the cavity length $L_C$.

11. The bullet of claim 10 wherein the rear segment average length $L_{RS}$ meets at least one additional criterion selected from the group of, measuring up to 1.500" in length, measuring up to 200% of the bullet diameter $D_B$, measuring up to 600% of a maximum petal thickness $T_P$, measuring up to 50% of a bullet overall length $L_B$, and measuring up to 100% of the cavity length $L_C$.

12. The bullet of claim 1 wherein said at least one characteristic includes the characteristics that, the rear segment average length $L_{RS}$ meets at least one criterion selected from the group of, measuring at least 370% of a maximum petal thickness $T_P$, measuring at least 65% of the cavity length $L_C$, and said notches each extend inwards to a sufficient depth relative to said cavity so as to create a web extending over at least a portion of a cavity length $L_C$ of said cavity, wherein web has a web thickness $T_W$ that meets at least one criterion selected from the group of, measuring between 0.001" and 0.100" in thickness, measuring between 0.4% and 15% of a bullet diameter $D_B$, measuring between 1% and 25% of a maximum petal thickness $T_P$.

13. The bullet of claim 12 wherein the web thickness $T_W$ meets at least one additional criterion selected from the group of, measuring between about 0.002" and 0.050", measuring between about 0.7% and 10% of the bullet diameter $D_B$, and measuring between 2% and 20% of the maximum petal thickness $T_P$.

14. The bullet of claim 13 wherein the web thickness $T_W$ meets at least one additional criterion selected from the group of, measuring between about 0.003" and 0.020", measuring between about 0.9% and 6% of the bullet diameter $D_B$, and measuring between 2.5% and 17% of the maximum petal thickness $T_P$.

15. The bullet of claim 2 wherein the rear segment average length $L_{RS}$ meets at least one criterion selected from the group of, measuring at least 0.400" in length, measuring at least 100% of the bullet diameter $D_B$, measuring at least 300% of a maximum petal thickness $T_P$, measuring at least 20% of a bullet overall length $L_B$, and measuring at least 50% of the cavity length $L_C$.

16. The bullet of claim 15 wherein the rear segment average length $L_{RS}$ meets at least one additional criterion selected from the group of, measuring up to 1.00" in length, measuring up to 175% of the bullet diameter $D_B$, measuring up to 500% of a maximum petal thickness $T_P$, measuring up to 40% of a bullet overall length $L_B$, and measuring up to 85% of the cavity length $L_C$.

17. A bullet comprising:

an elongated body terminating at a front end and a rear end, and symmetrically disposed about a longitudinal central axis;

a cavity terminating at said front end and extending rearward therefrom along the central axis;

a groove circumscribing said body at a location spaced apart from said front end; and a plurality of longitudinal notches extending generally parallel to the central axis and partially extending from said groove towards said rear end, and extending radially inwards towards said cavity, said notches each having a rear segment average length $L_{RS}$ defined by at least a segment of said notch formed by moving a cutting tool axially along said body, the cutting tool being moved so as to provide each of said notches with at least one characteristic selected from the group of, having a notch forward segment extending rearward from said front end to a discontinuity, and a notch rear segment defining the rear segment average length $L_{RS}$ and extending rearward from said discontinuity and aligned with said notch forward segment, and said notch being cut such that the rear segment average length $L_{RS}$ meets at least one criterion selected from the group of, measuring at least 370% of a maximum petal thickness $T_P$, measuring at least 65% of the cavity length $L_C$.

18. The bullet of claim 17 wherein at least a portion of said notch is formed by moving the cutting tool axially while the cutting tool is positioned at a depth of cut that creates a web extending over at least a portion of a cavity length $L_C$ of said cavity such that said web has a web thickness $T_W$ that meets at least one criterion selected from the group of, measuring between 0.001" and 0.100" in thickness, measuring between 0.4% and 15% of a bullet diameter $D_B$, and measuring between 1% and 25% of a maximum petal thickness $T_P$.

19. The bullet of claim 17 wherein said at least one characteristic includes the characteristic that said notches each have a notch forward segment extending rearward from said front end to a discontinuity, and a notch rear segment extending rearward from said discontinuity and aligned with said notch forward segment, further wherein said discontinuity is formed by a change in cut depth with said notch forward segment being formed by a shallower depth of cut than said notch rear segment.

* * * * *